US009939202B2

(12) United States Patent
Geskes et al.

(10) Patent No.: US 9,939,202 B2
(45) Date of Patent: Apr. 10, 2018

(54) HEAT EXCHANGER

(71) Applicant: Mahle Behr GmbH & Co. KG, Stuttgart (DE)

(72) Inventors: Peter Geskes, Ostfildern (DE); Klaus Irmler, Tuebingen (DE); Eberhard Pantow, Winnenden (DE); Michael Schmidt, Bietigheim-Bissingen (DE)

(73) Assignee: Mahle Behr GmbH & Co. KG (DE)

( * ) Notice: Subject to any disclaimer, the term of this patent is extended or adjusted under 35 U.S.C. 154(b) by 658 days.

(21) Appl. No.: 14/469,054

(22) Filed: Aug. 26, 2014

(65) Prior Publication Data

US 2015/0052893 A1 Feb. 26, 2015

(30) Foreign Application Priority Data

Aug. 26, 2013 (EP) ..... 13181663

(51) Int. Cl.
*F28D 9/00* (2006.01)
*F28D 7/00* (2006.01)
*F28D 7/16* (2006.01)

(52) U.S. Cl.
CPC ..... *F28D 9/0093* (2013.01); *F28D 7/0025* (2013.01); *F28D 7/0041* (2013.01); *F28D 7/1692* (2013.01); *F28D 9/0056* (2013.01)

(58) Field of Classification Search
CPC ..... F01K 23/065; F01N 5/02; F01N 2240/02; F28D 21/0003; F28D 2021/0071; F28D 9/0093; F28D 7/0041; F28D 7/1692; F28D 9/0056
See application file for complete search history.

(56) References Cited

U.S. PATENT DOCUMENTS 3,350,876 A * 11/1967 Johnson ..... F01K 23/14 60/618
4,232,522 A * 11/1980 Steiger ..... F01K 23/065 237/13
4,334,409 A * 6/1982 Daugas ..... F01K 23/065 60/618

(Continued)

FOREIGN PATENT DOCUMENTS

DE 102010042068 A1 4/2012
EP 2485002 A2 8/2012

OTHER PUBLICATIONS

English abstract for EP-2485002.

*Primary Examiner* — Tho V Duong
(74) *Attorney, Agent, or Firm* — Fishman Stewart PLLC

(57) ABSTRACT

A heat exchanger may include a gas conduit flowable through by a predetermined gas and a heat conduit flowable through by a predetermined fluid compound working fluid. The heat conduit may be in thermal communication with the gas conduit. The heat exchanger may include a first section having a first section length, a second section having a second section length, and a third section having a third section length. The gas conduit may span, in a direction of flow of the gas, the first section, the second section, and the third section. The heat conduit may span, in a direction of flow of the working fluid, the third section, the first section, and the second section. The first section may include a gas inlet and the third section may include a working fluid inlet and a gas outlet. The section may include a working fluid outlet.

18 Claims, 7 Drawing Sheets

(56) References Cited

U.S. PATENT DOCUMENTS

| | | | | |
|---|---|---|---|---|
| 7,571,718 | B2 * | 8/2009 | Hendrix | F28D 7/1684 123/563 |
| 2004/0159424 | A1 | 8/2004 | Reinke et al. | |
| 2010/0084120 | A1 * | 4/2010 | Yin | F22B 27/00 165/146 |
| 2010/0282452 | A1 * | 11/2010 | Diem | F01K 23/065 165/167 |
| 2011/0061388 | A1 * | 3/2011 | Lehar | F01K 23/10 60/653 |
| 2013/0133868 | A1 * | 5/2013 | Lehar | F01K 25/08 165/168 |
| 2013/0219880 | A1 | 8/2013 | Irmler | |

* cited by examiner

HEAT EXCHANGER

CROSS-REFERENCE TO RELATED APPLICATIONS

This application claims priority to European Patent Application No. EP 13 181 663.9 filed Aug. 26, 2013, the contents of which are hereby incorporated by reference in their entirety.

TECHNICAL FIELD

The invention pertains to a heat exchanger.

BACKGROUND

Internal combustion engines are used in various industrial applications for converting heat energy into mechanical energy. In motor vehicles, in particular heavy-goods vehicles, internal combustion engines are used to move the motor vehicle. The efficiency of internal combustion engines can be increased through the use of a system for utilizing waste heat of the internal combustion engine by means of the Rankine cycle. Such system converts waste heat of the internal combustion engine into mechanical energy. A known system includes a circuit having conduits for a working medium, for instance, water or an organic refrigerant such as R245fa, a pump for conveying the working medium, an evaporator heat exchanger for evaporating the liquid working medium, an expansion machine, a condenser for liquefying the evaporated working medium, and a collecting and compensating tank for the liquid working medium. Through the use of such systems in an internal combustion engine, the overall efficiency of the engine may be significantly increased.

In the evaporator heat exchanger, the working medium is evaporated using the waste heat of the engine, passed to the expansion machine, and expanded therein, performing a mechanical work delivered by the expansion machine as kinetic energy. In a typical evaporator heat exchanger, the working fluid is guided through a first conduit whereas the exhaust gas flow of the engine is guided through a second conduit. In this scenario, the heat from the exhaust gas may climb to a temperature in the range between 200° C. to 600° C., which is partly transferred to the working medium in the evaporator heat exchanger, allowing the working fluid to change from its liquid into a vaporous state of aggregation.

For use as a working medium for the Rankine cycle, numerous substances may be taken into consideration. Some of these substances, especially ethanol and organic fluids, possess threshold temperatures above which they decompose into highly toxic constituents. With such working media, the Rankine cycle cannot be operated continuously, rendering the use of waste heat of an internal combustion engine for increasing the efficiency of the engine merely possible. Some substances with an especially high threshold temperature may however be considered preferable from a thermodynamic point of view, for example, compared to water, because they allow greater efficiencies to be achieved and certain risks, such as the freezing of water, to be mitigated. Some such working media possess threshold temperatures ranging from 250° C. up to 400 or 500° C. When operating the Rankine cycle using exhaust gas as an energy source, passing exhaust gas of an external combustion engine through an evaporator heat exchanger, thus vaporizing the working medium in the evaporator heat exchanger, a counter-current flow is typically employed.

This means that the flow of the exhaust gas is guided in a direction opposite to that of the working fluid passing through the evaporator heat exchanger. This approach is necessary to allow maximum heating of the working medium for obtaining an optimum efficiency of the Rankine cycle. Guiding the media in such counter-current flow may cause the working medium to be heated up to the temperature of the exhaust gas entering the evaporator heat exchanger. While in such configuration the exhaust gas may climb to an inlet temperature ranging between 350° C. to 700° C., temperature in a conventional evaporator heat exchanger located in an exhaust tailpipe commonly does not exceed a maximum of 400° C. Such excessive heating of the working medium near its inlet may jeopardize its thermal resistance.

Although it is possible, by controlling the respective mass flows of exhaust gas and working medium, to maintain a working temperature beneath the given threshold, there remains a risk that, due to inhomogeneity of the working media in the evaporator heat exchanger, the threshold may still be exceeded locally. Even in such transient operating state, there is a risk of overheating the working medium, causing it to decompose.

WO 2009/089 885 A1 shows an exhaust gas installation that comprises an exhaust gas evaporator mounted downstream of an internal combustion engine of a motor vehicle. The exhaust gas evaporator has a sandwich-type structure wherein exhaust gas planes and coolant planes are alternately directly adjacently arranged, providing a very compact while very efficient exhaust gas evaporator.

DE 10 2009 022 865 A1 shows a Rankine cycle, having an inlet or injecting opening through which a medium is introduced into the cycle during stoppage, so that the medium replaces water in a sub-area of the cycle. A collecting vessel is provided with increased storage volume, and another collecting vessel accommodates water. Volume of the collecting vessels corresponds to volume of heat exchangers to be emptied. An air supply line and a water vapor line are attached at the injecting opening. A heating device is provided for producing water vapor.

An exhaust heat recovery heat exchanger is known from DE 10 2007 056 113 A1. This exchanger has a working fluid flow path extending through a housing between a working fluid inlet and a working fluid outlet, where the path includes a portion adjacent to the working fluid inlet and another portion spaced apart from the working fluid inlet. The flow of the working fluid along the latter portion of the working fluid flow path is parallel to the flow of the exhaust along an exhaust flow path adjacent to the latter portion of the working fluid's flow path.

SUMMARY

The object of the present invention therefore is to provide a heat exchanger—at competitive unit costs—that protects its working fluid from decomposition caused by overheating while achieving maximum thermal output.

This object is achieved by means of a heat exchanger comprising a gas conduit which is flown through or flowable through by a predetermined gas and a heat conduit which is flown through or flowable through by a predetermined fluid compound working fluid.

The heat conduit is in thermal communication with the gas conduit for conducting a fluid compound working fluid. The, heat exchanger comprises a first section of a first section length, a second section of a second section length, and a third section of a third section length, wherein the gas conduit spans, in direction of flow of the predetermined gas, the first section, the second section, and the third section, wherein the heat conduit spans, in direction of flow of the predetermined working fluid, the third section, the first section, and the second section, wherein the first section comprises a gas inlet for inletting the predetermined gas and the third section comprises a working fluid inlet for inletting the predetermined working fluid, wherein the third section comprises a gas outlet for discharging the predetermined gas and the second section comprises a working fluid outlet for discharging the predetermined working fluid, wherein the gas conduit is passable by the predetermined gas from the gas inlet to the gas outlet, wherein the heat conduit is passable by the predetermined working fluid from the working fluid inlet to the working fluid outlet, and wherein the first section length is selected such that the predetermined gas, when entering the operational heat exchanger through the gas inlet at a gas entry temperature of up to 700° C., exceeds a decomposition temperature of the working fluid by up to 50 K upon exiting the first section, provided that the predetermined working fluid enters the first section in a liquid state of aggregation.

A principal idea underlying the invention is thus to avoid the endothermic chemical reaction known in the art as thermal decomposition or thermolysis, which reaction would otherwise cause the working fluid's chemical bonds to break. By effectively limiting the first section dimensions and resulting gas temperature to the claimed level, any chance of decomposition of the predetermined working fluid passing alongside the gas conduit is minimized, thus allowing for a continuous operation of the heat exchanger without risking disintegration or breakdown of the predetermined working fluid contained therein.

In a preferred embodiment, the first section is even further restricted in length such that the predetermined gas falls short of a threshold 50 K below the working fluid's decomposition temperature. This configuration provides for an additional safety margin, eliminating any threat of the working fluid decomposition even locally.

Use of a first section between 80 mm and 300 mm in length permits a targeted optimization of the desired temperature window of the predetermined working fluid, taking into account any application-specific requirements to be considered.

With respect to the heat exchanger's second and third sections, a second section length between 80 mm and 300 mm and third section lengths between 100 mm and 400 mm prove particularly advantageous. On the one hand, the proposed dimension of the second section allows the predetermined working fluid to overheat marginally, yet remaining below its specific temperature of decomposition. On the other hand, the third section length suggested provides for the predetermined working fluid to heat up to its predetermined boiling point, permitting its temporary evaporation within the heat conduit.

Regarding gas exit temperature, an advisable target range between 100° C. and 150° C. prevents a Diesel engine thus equipped to exceed its permissible amount of mononitrogen oxides, commonly labeled $NO_x$, produced through the reaction of nitrogen and oxygen gases during combustion. Such limitation in turn helps avoid the formation of photochemical so-called smog, acid rain, tropospheric ozone, and other similar air pollutants, otherwise threatening to adversely affect susceptible individuals as well as the natural environment. Furthermore, pressurizing the working fluid to a level of 20 bar to 50 bar before entry into the heat exchanger allows for the expansion unit to perform at its thermodynamically optimal operating point.

Finally, a predetermined working fluid exhibiting a decomposition temperature between 300° C. and 350° C. may be considered a favorable choice in terms of its thermal stability. This range would include particularly effective chlorofluorocarbons (CFCs) such as dichlorodifluoromethane (R-12, Freon-12) as well as the widely available ethanol.

The person skilled in the art will appreciate that various serrations and other geometrical variations may be applied to the heat transfer surfaces, such as pipe ribs, web ribs, wave ribs, rib packages or pin-fin types of arrangements. Similarly, the piping may be coiled or enhanced by the embossment of so-called winglets.

Further important features and advantages of the invention may be gathered from the dependent claims, drawings, and complementary description in the light of the drawings.

BRIEF DESCRIPTION OF THE DRAWINGS

In the following, embodiments of the invention will be described with reference to the accompanying drawings, wherein.

DETAILED DESCRIPTION

Figure 1:
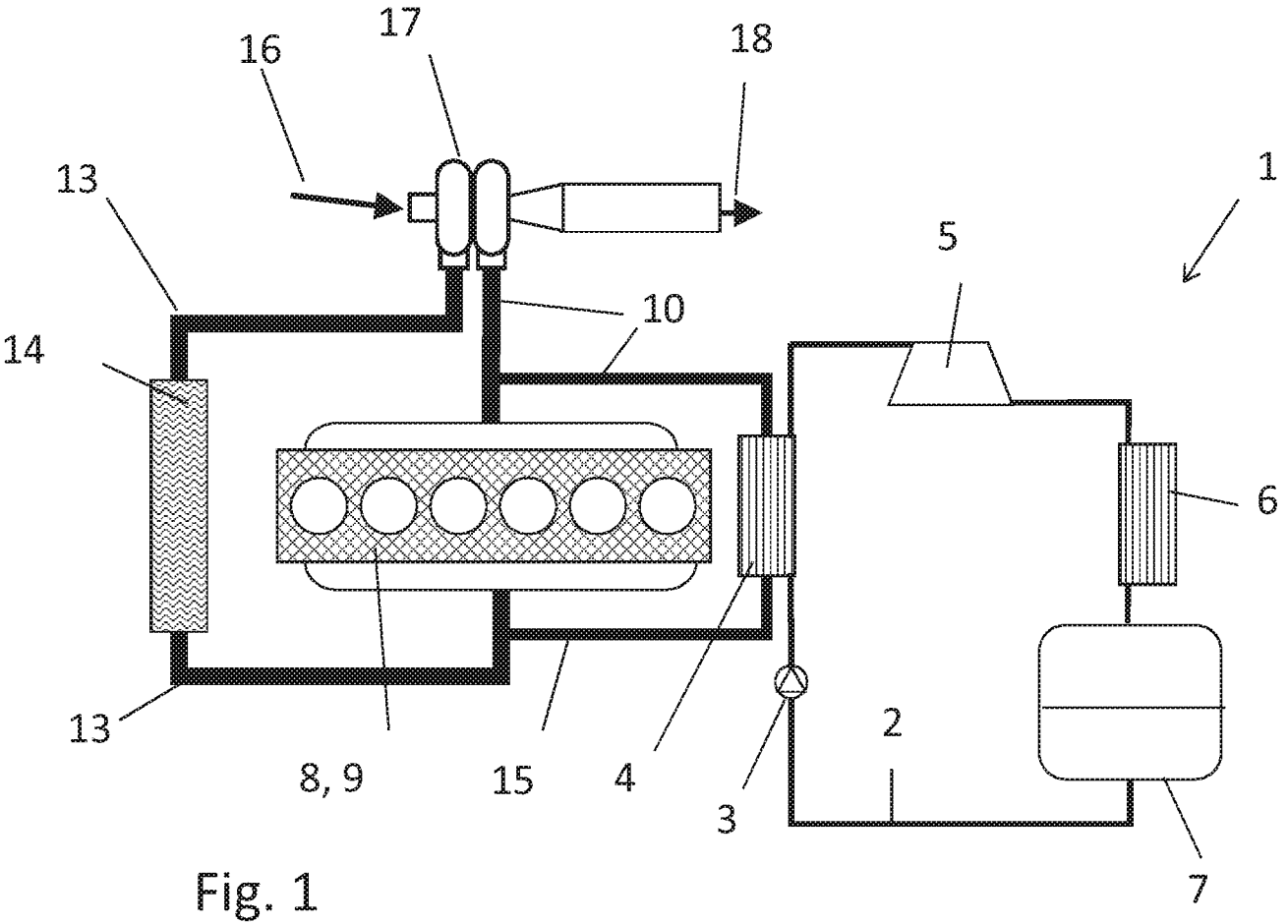
FIG. 1 shows a highly simplified illustration of an internal combustion engine with a system for utilizing waste heat of the engine.

Referencing FIG. 1, an internal combustion engine 8 in the form of a reciprocating piston engine 9 for driving a motor vehicle, especially a heavy-goods vehicle, includes a system 1 for recovering waste heat of the internal combustion engine 8 by means of the Rankine cycle. The internal combustion engine 8 comprises an exhaust-gas turbocharger 17. This turbocharger 17 compresses fresh air 16 into a charge-air conduit 13, which is cooled by means of an intercooler 14 before being supplied to the internal combustion engine 8. Through an exhaust pipe 10, part of the exhaust gas 18 resulting from the combustion is discharged from the internal combustion engine 8, again cooled by a heat exchanger 4 serving as an exhaust gas recirculation cooler, and fed back through a gas recirculation line 15 of the internal combustion engine 8 into the charge-air conduit 13. A further part of the exhaust gas 18 is used to drive the turbocharger 17 before being discharged into the surrounding atmosphere.

In addition to such apparatus, a second evaporator heat exchanger (not depicted in FIG. 1) may be employed for cooling the exhaust gas 18 before discharging it into the environment, thus recovering its heat as well. The system 1 comprises a duct 2 filled with a predetermined fluid compound, e.g. Ethanol or Chlorofluorocarbon, serving as a working fluid. An expansion unit 5, a capacitor 6, a reservoir 7, and a pump 3 are embedded into the circuitry thus formed. From the pump 3, the liquid working fluid passing through the circuit is compressed to an elevated pressure level, evaporated by the heat exchanger 4, and passed in its gaseous form to the expansion unit 5 to perform mechanical work, consequently dropping back to its regular pressure. Inside the capacitor 6, the gaseous working fluid is again liquefied and finally returned to its reservoir 7.

Figure 2:
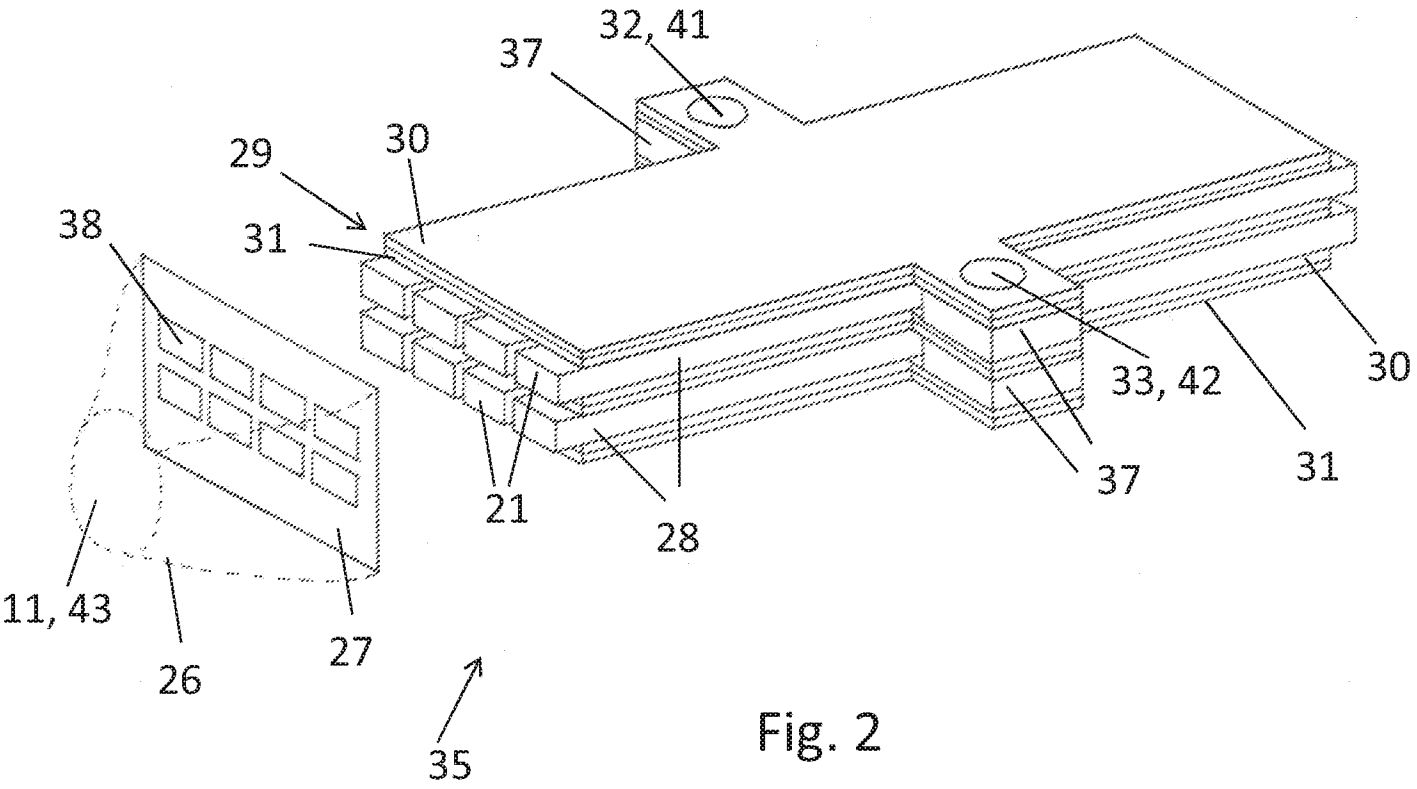
FIG. 2 shows an evaporator heat exchanger in its disassembled state.
Figure 3:
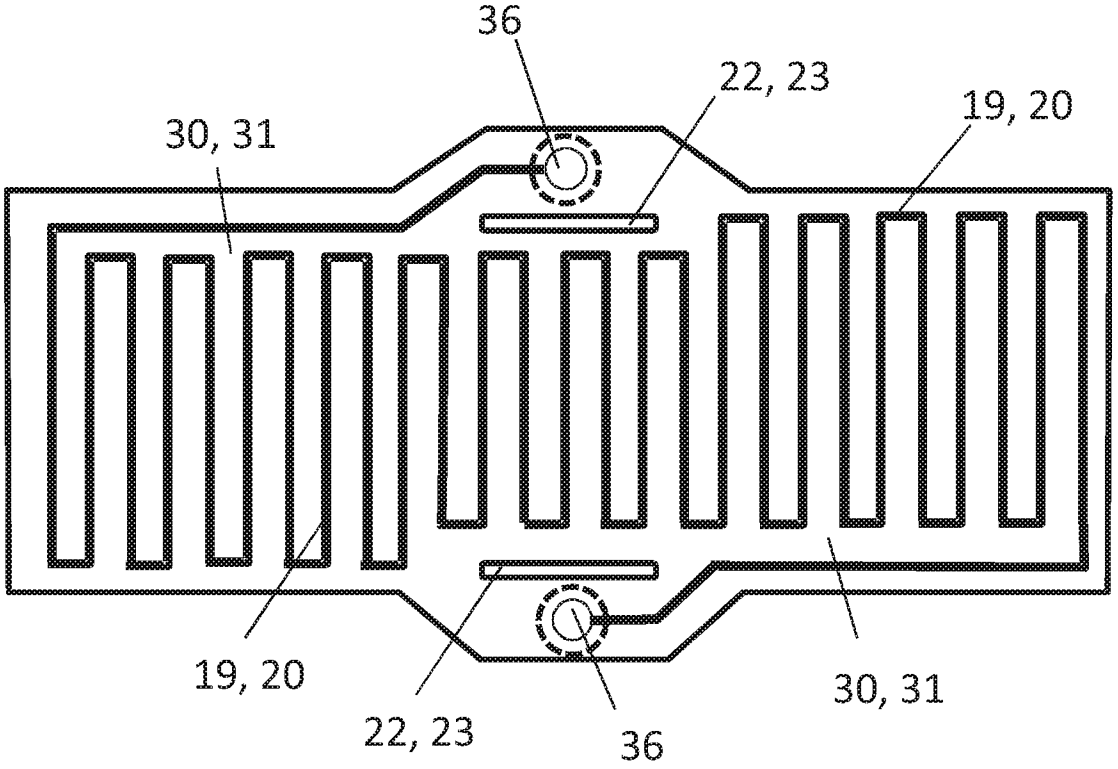
FIG. 3 shows a plan view of a single slice of the exchanger according to FIG. 2.
Figure 4:
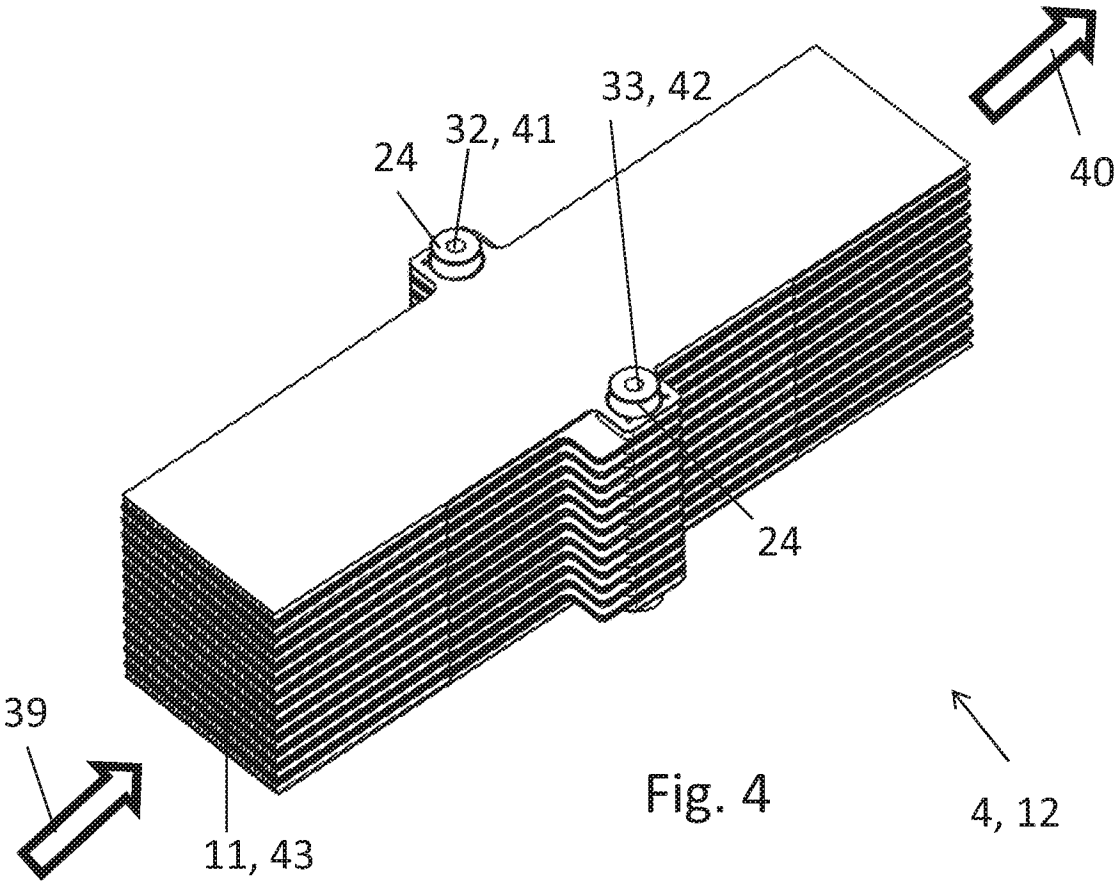
FIG. 4 shows a perspective view of the exchanger according to FIG. 2 in its assembled state.

FIGS. 2 to 4 illustrate a constructional assembly 35 of the heat exchanger 4, 12. The assembly 35 shown comprises a working fluid inlet 32 and a working fluid inlet zone 41 for inletting the working fluid and a working fluid outlet 33 and a working fluid outlet zone 42 for discharging the working fluid from the heat exchanger 4 and the assembly 35. A heat conduit 19 (not depicted in FIG. 2) is formed between a plurality of plate pairs 29, each pair 29 comprising an upper plate 30 and a lower plate 31, mutually separated by a suitably sized spacer 37. Furthermore, a channel 20 meandering through the lower plate 31 forms a heat conduit 19 (FIG. 3), guiding the working fluid from its working fluid inlet 32 and working fluid inlet zone 41 to the working fluid outlet 33 and working fluid outlet zone 42. Though not discernible in the figures at hand, the upper and lower plates 30, 31 are mutually bonded by means of brazing. The plate pairs 29 of the assembly 35 are stacked above another, holding a corresponding number of pipes 28 between them. FIGS. 2 and 3 illustrate this stacking configuration only partially.

The upper and lower plates 30, 31 further include through holes 36 constituting the working fluid inlet 32 and outlet 33 and their respective working fluid inlet and outlet zones 41, 42, the through holes 36 touching the spacers 37 between each plate pair 29 (FIG. 2) and thus allowing the working fluid to pass through each plate pair 29 to the neighboring plate pairs 29 located above and below. The through holes 36 consequently extend through the spacers 37. Between each plate pair 29, four pipes 28 of rectangular cross section are arranged. These pipes 28 form a gas conduit 21 for conducting the exhaust gas 18, allowing heat to be transferred to the working fluid from said exhaust gas 18 while evaporating the working fluid on its way through the heat exchanger 4.

A base plate 27 (FIG. 2) comprises diffusor ports 38 rectangular in cross section and is again connected integrally to the pipes 28 by brazing. The base 27 holds a gas diffusor 26 (indicated in FIG. 2 by means of a dotted line) comprising a gas inlet 11 and a gas inlet zone 43 for inletting the exhaust gas 18. For illustrative purposes, the exploded view of FIG. 2 shows the base 27 detached from the pipes 28.

The components of the heat exchanger 4—for instance, the plate pairs 29, gas diffusor 26, and spacers 37—are manufactured from stainless steel or aluminum and cohesively connected by brazing or gluing.

FIG. 3 shows the plates 30, 31 of the assembly 35 in detail. The upper and lower plates 30, 31 comprise the two through holes 36, allowing the working fluid to pass through each of them. Furthermore, the channel 20 forming the heat conduit 19 is worked into the lower plate 31, connecting the through holes 36 end-to-end. Thus, the working fluid is guided from the upper (inlet) through hole 36 through the channel 20 on to the lower (outlet) through hole 36. As indicated above, the spacers 37 arranged between two adjacent plate pairs 29 (FIG. 2) are traversed by the through holes 36 as well. Expansion gaps 22 formed by expansion slots 23 prevent thermal stress.

FIG. 4 shows a perspective view of the heat exchanger 4, 12. At the two through holes 36 of the top plate 30, a socket 24 is arranged. The socket 24 serves to access the working fluid inlet 32 and inlet zone 41 as well as the working fluid outlet 33 and outlet zone 42. The exhaust gas 18 passes through the gas conduit 21 formed between the plate pairs 29. Thus, the exhaust gas 18 enters in an inflow 39 and the assembly 35 of the heat exchanger 4, 12 in an outflow 40. Preferably, several assemblies 35 and/or the entire heat exchanger 4, 12 are encased by means of a suitably dimensioned housing (not depicted), guiding the exhaust gas 18 from one assembly 35 to the next.

Figure 5:
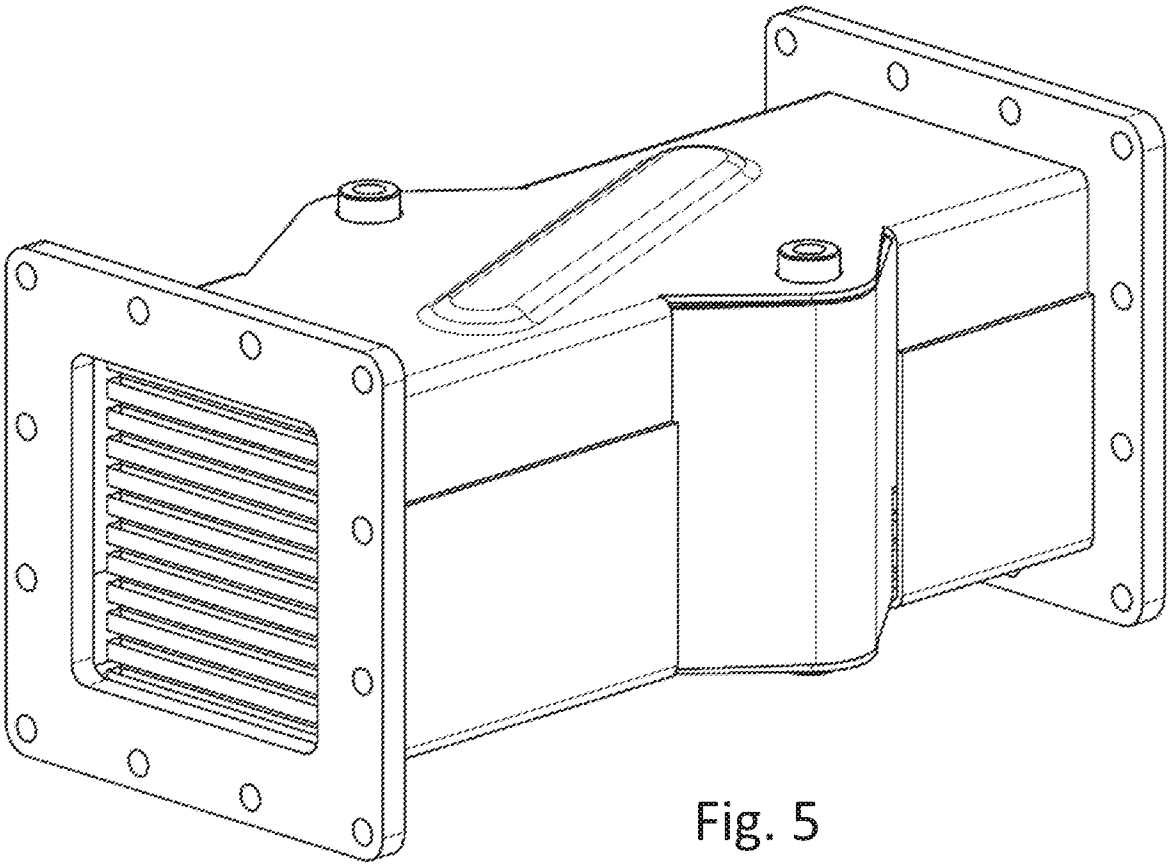
FIG. 5 shows a housing of the exchanger according to FIG. 2.

FIG. 5 shows a housing of the heat exchanger 4, 12. The plates are stacked up and brazed and the housing around the core guides the exhaust gas through the core.

Figure 6:
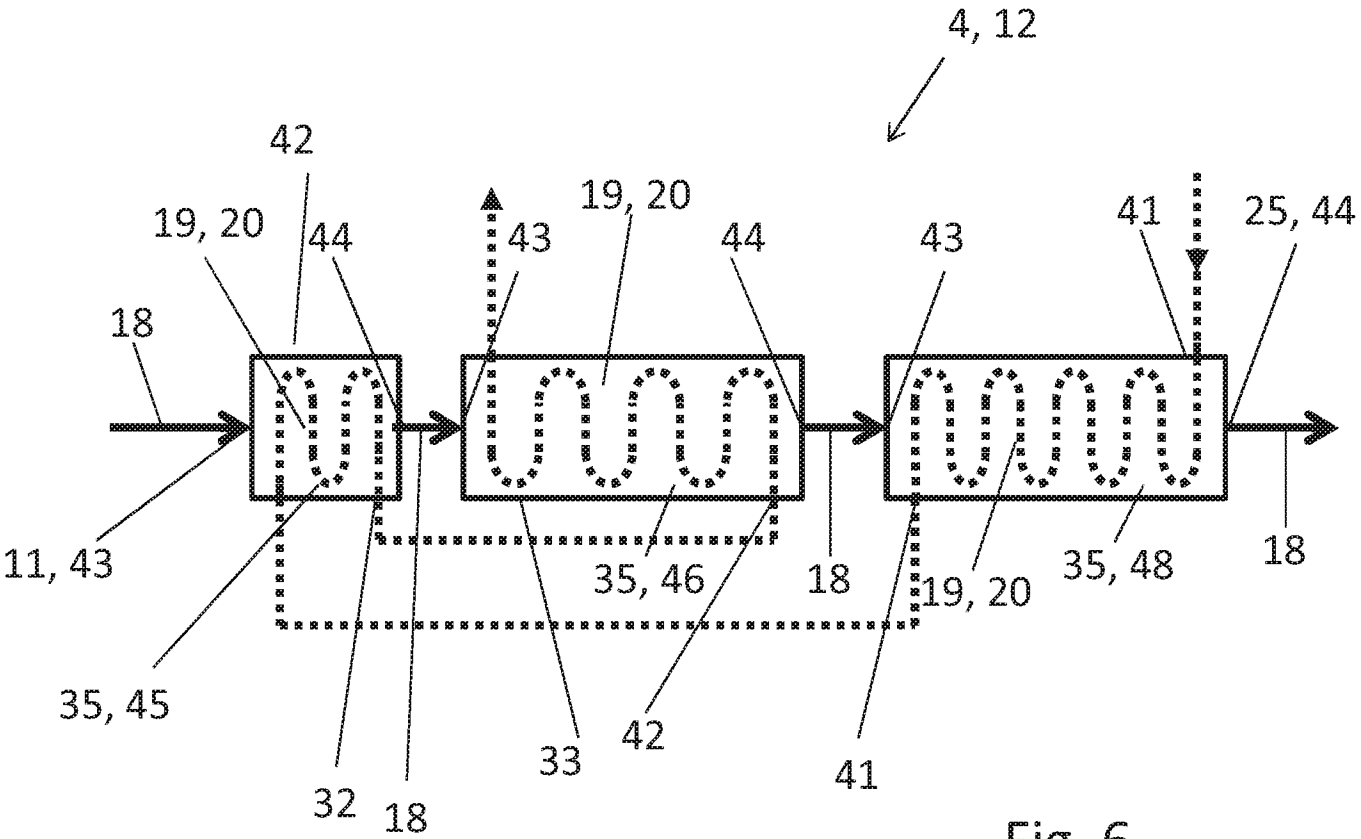
FIG. 6 shows the flow scheme of a heat exchanger according to an embodiment of the invention.

FIG. 6 shows an embodiment of the inventive heat exchanger 4, 12 comprising three assemblies 35 as shown in FIGS. 2 to 4. In FIG. 5, these assemblies 35 are simplified for illustrative purposes. The three assemblies 35 are successively traversed from left to right by exhaust gas 18, thus forming first, second, and third sections 45, 46, 48 of the heat exchanger 4, 12.

As can be gathered from the figure, the assembly 35 forming the first section 45 of the heat exchanger 4, 12 is substantially smaller than the assemblies 35 forming the second and third sections 46, 48. Specifically, in the embodiment shown in FIG. 5, the first section 45 measures 10 cm whereas the second and third sections 46, 48 each measure 30 cm in length. The exhaust gas 18 enters the first section 45 through the gas inlet 11 at a gas entry temperature of up to 700° C. and is passed on to a gas outlet zone 44 of the first section 45 to enter the second section 46 through a gas inlet zone 43. Mutatis mutandis, this flow scheme spans the second section 46 and third section 48 until the exhaust gas 18 finally exits the heat exchanger 4, 12 through the gas outlet 25, ultimately tempered between 100° C. and 150° C. Upon exiting the first section 45, the exhaust gas 18 has dropped to a temperature level that exceeds the working fluid's decomposition temperature by no more than 50 K. At an exemplary decomposition temperature of 300° C. to 350° C., the working fluid configuration thus causes the exhaust gas 18 to drop below a level of, at maximum, 400° C.

The working fluid, still liquid at a relatively low temperature of between 60° C. and 80° C. and pressurized to between 20 bar and 50 bar, enters the third section 48 of the heat exchanger 4, 12 from the reservoir 7 through the working fluid inlet 32 (FIG. 1) and, due to the geometry of heat transfer surfaces, is only slightly heated to a temperature level of about 200° C., thus staying short of its specific decomposition temperature.

The working fluid enters the third section 48 through the working fluid inlet 32, passes into the first section 45 and further into the second section 46, where it is finally discharged from the heat exchanger 4, 12. In traversing the third section 48, the exhaust gas 18 is cooled down significantly. The working fluid passes through the first section 45 in a co-current flow to avoid decomposing.

Figure 7:
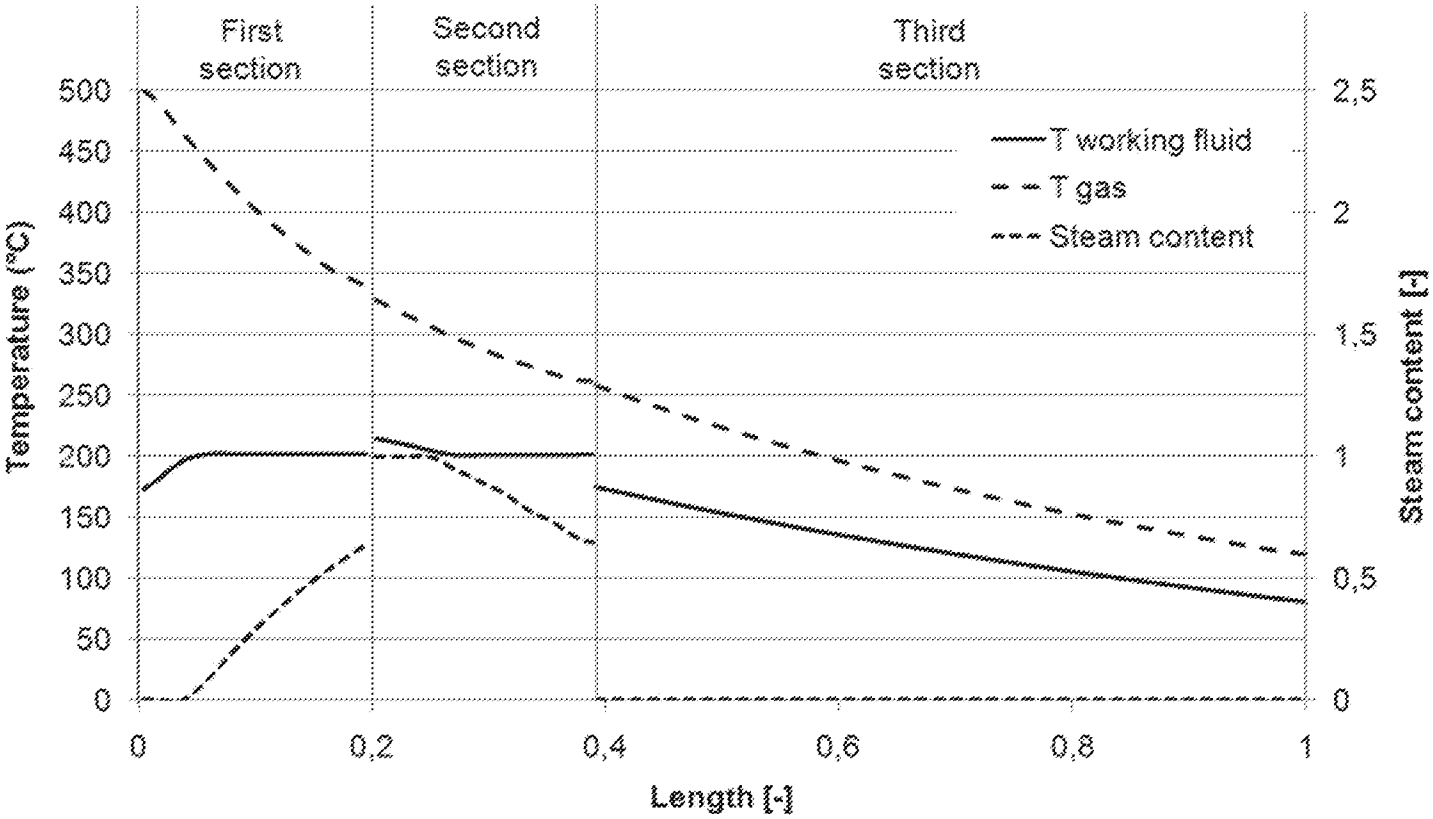
FIG. 7 shows a diagram with the gradients of the working fluid's temperature, the gas temperature and the steam content in the respective section of the exchanger according to FIG. 6.

FIG. 7 shows a diagram illustrating the gradient of the working fluid's temperature, the gas temperature and the steam content in the first section 45, second section 46 and third section 48 of the embodiment of the inventive heat exchanger 4, 12.

The invention claimed is:

1. A heat exchanger, comprising:

a gas conduit flowable through by a predetermined gas, a heat conduit flowable through by a predetermined fluid compound working fluid, the heat conduit in thermal communication with the gas conduit, a first section having a first section length, a second section having a second section length, and a third section having a third section length, wherein the gas conduit spans, in a direction of flow of the gas, the first section, the second section, and the third section, and the heat conduit spans, in a direction of flow of the working fluid, the third section, the first section, and the second section, the first section including a gas inlet for inletting the gas and the third section including a working fluid inlet for inletting the working fluid, the third section including a gas outlet for discharging the gas and the second section including a working fluid outlet for discharging the working fluid, wherein the gas conduit is passable by the gas from the gas inlet to the gas outlet, and the heat conduit is passable by the working fluid from the working fluid inlet to the working fluid outlet, wherein the first section length is selected such that the gas, when entering the gas inlet at a gas entry temperature of up to 700° C., exits the first section at a gas exit temperature no more than 50 K above a decomposition temperature of the working fluid, provided that the working fluid enters the first section in a liquid state of aggregation, and wherein the first section length ranges between 80 mm and 300 mm, and the third section length is greater than the second section length.

2. A heat exchanger, comprising:

a gas conduit for conducting a gas, a heat conduit in thermal communication with the gas conduit for conducting a fluid compound working fluid, a first section having a first section length, a second section having a second section length, and a third section having a third section length, wherein the gas conduit spans, in a direction of flow of the gas, the first section, the second section, and the third section, and the heat conduit spans, in a direction of flow of the working fluid, the third section, the first section, and the second section, wherein the first section includes a gas inlet for inletting the gas and the third section includes a working fluid inlet for inletting the working fluid, and the third section includes a gas outlet for discharging the gas and the second section includes a working fluid outlet for discharging the working fluid, wherein the gas conduit is passable by the gas from the gas inlet to the gas outlet, the heat conduit is passable by the working fluid from the working fluid inlet to the working fluid outlet, wherein the first section length is selected such that the gas, when entering the gas inlet at a gas entry temperature of up to 700° C., exits the first section at a gas exit temperature no more than 50 K above a decomposition temperature of the working fluid, and wherein the first section length ranges between 80 mm and 300 mm, and the third section length is greater than the second section length.

3. The heat exchanger as in claim 1, wherein the first section length enables the gas to exit the first section below the decomposition temperature by up to 50 K.

4. The heat exchanger as in claim 1, wherein the second section length ranges between 80 mm and 300 mm and the third section length ranges between 100 mm and 400 mm.

5. The heat exchanger as in claim 1, wherein the first section length, the second section length, and the third section length are selected such that the gas, upon entering the gas inlet, exits through the gas outlet at an exit temperature between 100° C. and 150° C., provided that the working fluid enters through the working fluid inlet at a working fluid entry temperature between 60° C. and 80° C. and an entry pressure between 20 bar and 50 bar.

6. The heat exchanger as in claim 1, wherein the decomposition temperature ranges between 250° C. and 350° C.

7. The heat exchanger as in claim 2, wherein the first section length enables the gas to exit the first section below the decomposition temperature by up to 50 K.

8. The heat exchanger as in claim 2, wherein the second section length ranges between 80 mm and 300 mm, and the third section length ranges between 100 mm and 400 mm.

9. The heat exchanger as in claim 2, wherein the first section length, the second section length, and the third section length are determined such that the gas, upon entering the gas inlet, exits through the gas outlet at an exit temperature between 100° C. and 150° C., provided that the working fluid enters through the working fluid inlet at a working fluid entry temperature between 60° C. and 80° C. and an entry pressure between 20 bar and 50 bar.

10. The heat exchanger as in claim 2, wherein the decomposition temperature ranges between 250° C. and 350° C.

11. The heat exchanger as in claim 3, wherein the second section length ranges between 80 mm and 300 mm, and the third section length ranges between 100 mm and 400 mm.

12. The heat exchanger as in claim 4, wherein the first section length, the second section length, and the third section length are determined such that the gas, upon entering the gas inlet, exits through the gas outlet at an exit temperature between 100° C. and 150° C., provided that the working fluid enters through the working fluid inlet at a working fluid entry temperature between 60° C. and 80° C. and an entry pressure between 20 bar and 50 bar.

13. The heat exchanger as in claim 12, wherein the decomposition temperature ranges between 250° C. and 350° C.

14. The heat exchanger as in claim 5, wherein the decomposition temperature ranges between 250° C. and 350° C.

15. A heat exchanger for an internal combustion engine, comprising:

a gas conduit flowable through by a predetermined gas;

a heat conduit flowable through by a predetermined fluid compound working fluid, the heat conduit in thermal communication with the gas conduit;

a first section having a first section length, a second section having a second section length, and a third section have a third section length, wherein the gas conduit spans, in a direction of flow of the gas, the first section, the second section, and the third section, and the heat conduit spans, in a direction of flow of the working fluid, the third section, the first section, and the second section;

the first section including a gas inlet for inletting the gas and the third section including a working fluid inlet for inletting the working fluid;

the third section including a gas outlet for discharging the gas and the second section including a working fluid outlet for discharging the working fluid;

wherein the gas conduit is passable by the gas from the gas inlet to the gas outlet, and the heat conduit is passable by the working fluid from the working fluid inlet to the working fluid outlet;

wherein the first section length ranges between 80 mm and 300 mm, the second section length ranges between 80 mm and 300 mm, and the third section length is greater than the second section length and ranges between 100 mm and 400 mm, the first section length being determined at least in part such that the gas, when entering the gas inlet at a gas entry temperature of up to 700° C., exceeds a decomposition temperature of the working fluid by up to 50 K upon exiting the first section, provided that the working fluid enters the first section in a liquid state of aggregation; and wherein the first section length, the second section length, and the third section length are determined such that the gas, upon entering the gas inlet, exits through the gas outlet at an exit temperature between 100° C. and 150° C., provided that the working fluid enters through the working fluid inlet at a working fluid entry temperature between 60° C. and 80° C. and an entry pressure between 20 bar and 50 bar.

16. The heat exchanger as in claim 4, wherein the second section length enables the working fluid to overheat in the second section, and the third section length enables the working fluid to temporarily evaporate within the heat conduit.

17. The heat exchanger as in claim 8, wherein the second section length enables the working fluid to overheat in the second section, and the third section length enables the working fluid to temporarily evaporate within the heat conduit.

18. The heat exchanger as in claim 15, wherein the second section length enables the working fluid to overheat in the second section, and the third section length enables the working fluid to temporarily evaporate within the heat conduit.

* * * * *